US005560660A

United States Patent [19]

Tserng

[11] Patent Number: 5,560,660

[45] Date of Patent: Oct. 1, 1996

[54] LATCH MECHANISM FOR A CASE

[76] Inventor: Yueh-Chy Tserng, No. 26-21, Shi She Juang, Shi She Li, Chang Hua, Taiwan

[21] Appl. No.: 510,237

[22] Filed: Aug. 2, 1995

[51] Int. Cl.[6] ..... A45C 13/12

[52] U.S. Cl. ..... 292/341.17; 292/DIG. 50; 24/634

[58] Field of Search ..... 292/341.17, DIG. 50; 24/634, 635, 662

[56] References Cited

U.S. PATENT DOCUMENTS 1,047,782 12/1912 German ..... 24/662 X 1,510,292 9/1924 Anderson ..... 292/DIG. 50 X

*Primary Examiner*—Rodney M. Lindsey

*Attorney, Agent, or Firm*—Charles E. Baxley, Esq.

[57] ABSTRACT

A latch mechanism for securing a cover to a case includes a board secured to the case and having a projection. A disc is secured to the cover and has a tapered bore. A cap is fixed to the disc and has a ring extended away from the disc. A chuck is slidably engaged in the ring and has a number of blades for engaging with the tapered bore. A spring may bias the blades to engage with the tapered bore. The blades may move radially inward to hold the projection when the chuck is biased toward the tapered bore and the blades may be disengaged from the projection when the chuck is moved away from the tapered bore.

1 Claim, 3 Drawing Sheets

LATCH MECHANISM FOR A CASE

BACKGROUND OF THE INVENTION

1. Field of the Invention

The present invention relates to a latch, and more particularly to a latch mechanism for a case.

2. Description of the Prior Art

Typical cases comprise a case body and a cover for enclosing the case body. A latch or lock mechanism is provided for securing the cover to the case body. One type of the latch mechanisms includes two magnet members secured to the case body and to the cover respectively so as to attract toward each other and in order to secure the cover to the case body. However, the magnets may be easily disengaged from each other when an external force is applied onto the case such that the objects received in the case may be easily stolen. In addition, the magnets may be easily demagnetized such that the cover may not be stably secured to the case body.

Another type of the latch mechanisms comprise a latch engagable in a socket in a force-fitted engagement so as to secure the cover to the case body. However, the users may not easily force the latch into the sockets and may not easily disengage the latch from the sockets.

The present invention has arisen to mitigate and/or obviate the afore-described disadvantages of the conventional latch mechanisms for cases.

SUMMARY OF THE INVENTION

The primary objective of the present invention is to provide a latch mechanism which may solidly secure the cover to the case body and which allows the cover to be easily disengaged from the case body.

In accordance with one aspect of the invention, there is provided a latch mechanism for securing a cover to a case body, the latch mechanism comprises a board for securing to the case body, the board including a projection extended therefrom, a disc for securing to the cover, the disc including a bore formed therein for engaging with the projection and having a tapered surface formed therein, a cap secured to the disc and including a ring extended away from the disc, a chuck slidably engaged in the ring and including a plurality of blade means extended therefrom for engaging with the tapered surface of the bore, means for biasing the blade means of the chuck to engage with the tapered surface of the bore, and a knob means secured to the chuck for moving the blade means of the chuck away from the bore against the biasing means. The blade means are caused to move radially inward so as to hold the projection in place when the chuck is biased toward the projection, and the blade means are moved radially outward so as to be disengaged from the projection when the chuck is pulled away from the projection by the knob means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
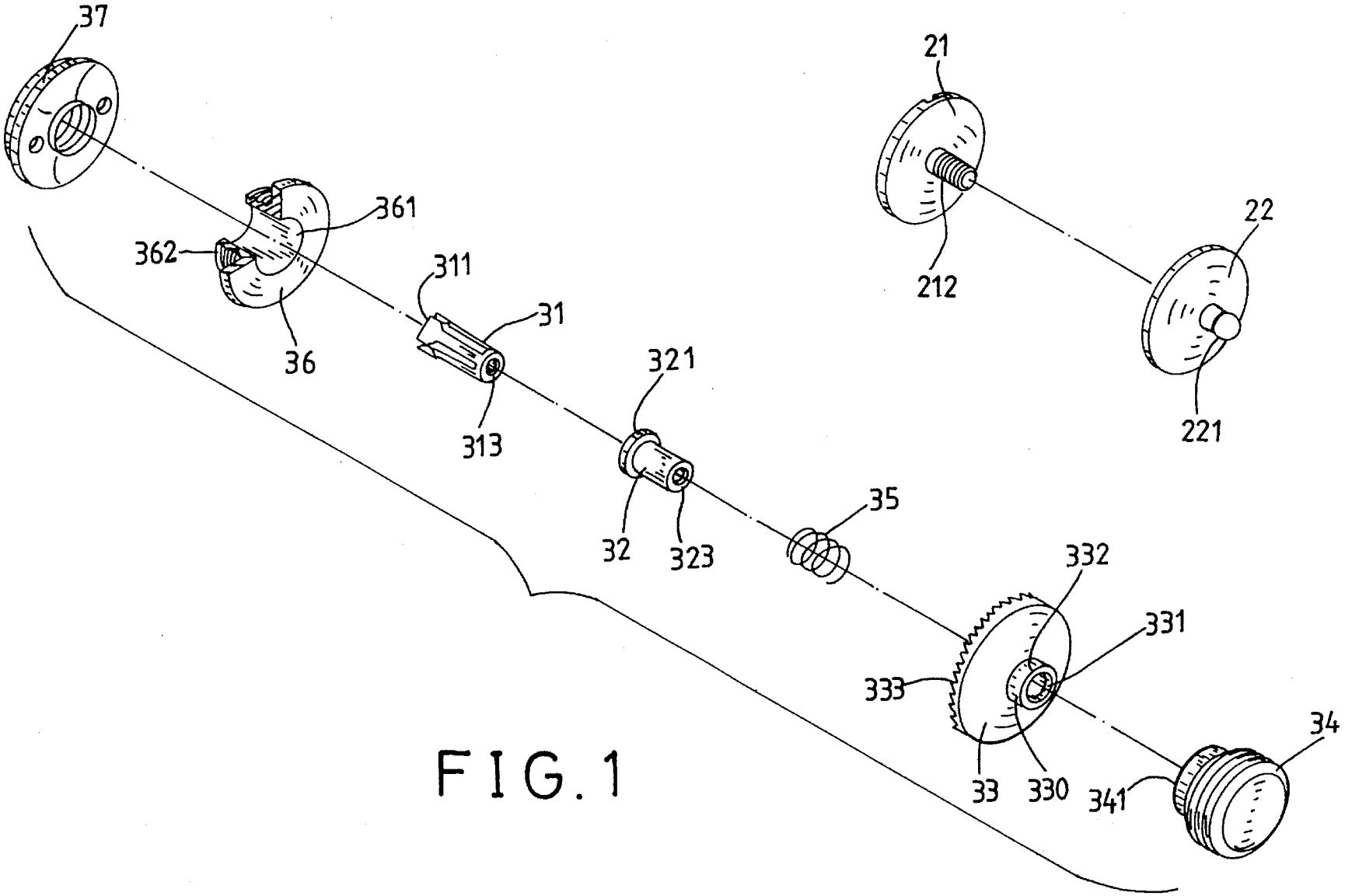
FIG. 1 is an exploded view of a latch mechanism for a case in accordance with the present invention.
Figure 2:
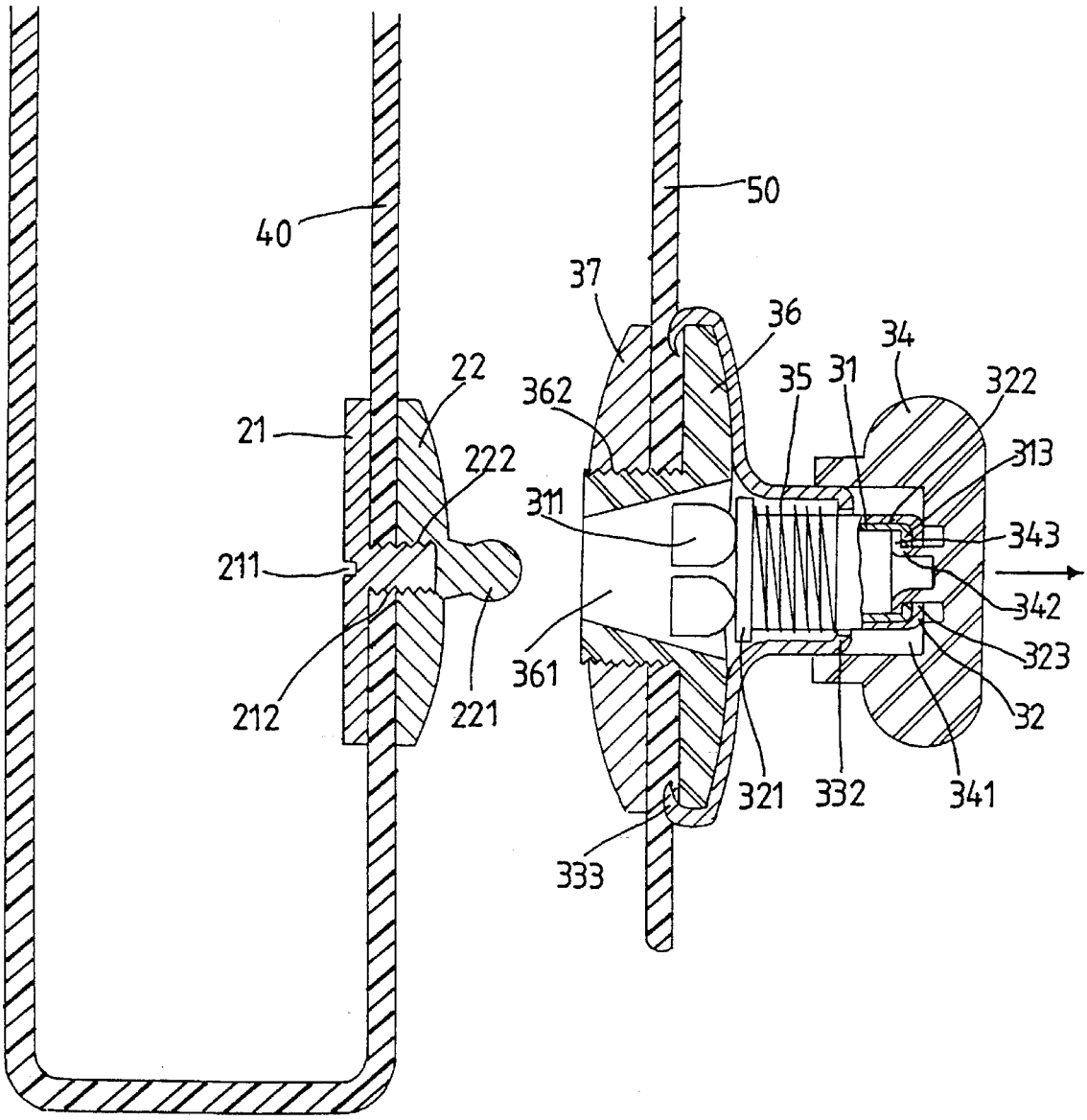
FIGS. 2 and 3 are cross sectional views illustrating the operation of the latch mechanism.
Figure 3:
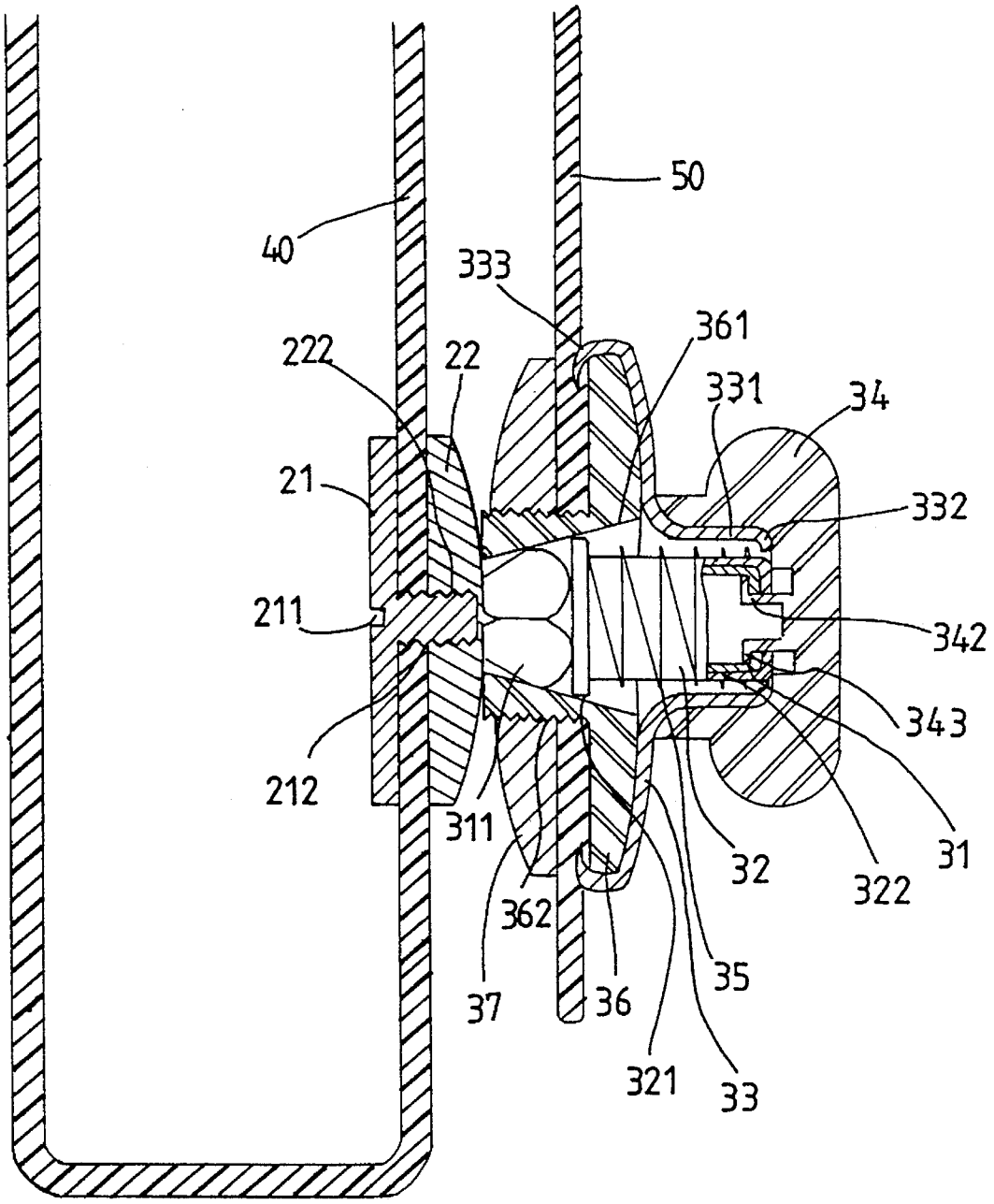

Referring to the drawings, and initially to FIGS. 1 and 2, a latch mechanism in accordance with the present invention is provided for securing a cover 50 to the case body 40 and comprises a plate 21 including a bolt 222 extended therefrom for engaging with a screw hole 222 formed in another board 22. The board 22 includes a projection 221 extended therefrom. The plate 21 includes a groove 211 formed therein opposite to the bolt 212 for engaging with a screw driver means so as to be rotated by the screw driver means. The bolt 212 of the plate 21 is engaged through the front portion of the case body 40, best shown in FIGS. 2 and 3.

A disc 36 includes a screw 362 extended therefrom for engaging through the cover 50 and for threadedly engaging with a nut 37 so as to be secured to the cover 50. The disc 36 includes a bore 361 having a tapered surface formed therein so as to form a frustum-shaped bore. A cap 33 includes a number of teeth 333 formed in the peripheral portion and arranged to be folded relative to the cap 33 so as to engage with the peripheral portion of the disc 36 and so as to secure the cap 33 to the disc 36. The cap 33 includes a ring 330 extended away from the disc 36 and having a hole 331 formed therein and having an annular flange 332 extended radially inward from the end portion.

A barrel 32 is slidably engaged in the ring 330 and includes an annular rib 321 extended radially outward from one end thereof and includes a hollow interior 322 and includes an annular flange 323 extended radially inward from the other end. A spring 35 is biased between the annular flange 332 of the cap 33 and the annular rib 321 of the barrel 32 so as to bias the barrel 32 inward of the frustum shaped bore 361 of the disc 36. A chuck 31 is engaged in the barrel 32 and includes an annular flange 313 extended radially inward from one end and engaged with the annular flange 323 of the barrel 32, and includes three or more blades 311 extended therefrom and partially extended outward of the barrel 32, best shown in FIGS. 2 and 3, for engaging with the frustum-shaped bore 361 of the disc 36.

A knob 34 includes a cavity 341 formed therein for engaging with the ring 330 and includes two or more extensions 342 extended therein for engaging through the annular flanges 323 and 313 of the barrel 32 and the chuck 31. The free end portions of the extensions 342 are bent in order to engage with the annular flanges 3230, 313 so as to secure the knob 34 to the barrel 32 and the chuck 31, such that the barrel 32 and the chuck 31 and the knob 34 move in concert.

In operation, as shown in FIG. 2, the blades 311 may be disengaged from the tapered surface of the bore 361 of the disc 36 when both the chuck 31 and the barrel 32 are pulled away from the disc 36 by the knob 34. At this moment, the projection 221 may be engaged into the bore 361. When the knob 34 is released, the barrel 32 and the chuck 31 and the knob 34 may be forced toward the projection 221 by the spring 35. At this moment, the free end portions of the blades 311 may be forced to move radially inward by the engagement with the tapered surface of the bore 361 in order to hold the projection 221 in place and so as to secure the cover 50 to the case body 40. When it is required to release the projection 221, it is only required to pull the knob 34 away from the projection 221 again, the free end portions of the blades 311 may move radially outward when the blades are disengaged from the tapered surface of the bore 361.

Accordingly, the latch mechanism in accordance with the present invention may solidly secure the cover to the case body and allows the cover to be easily disengaged from the case body.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A latch mechanism for securing a cover to a case body, said latch mechanism comprising:

a board for securing to the case body, said board including a projection extended therefrom, a disc for securing to the cover, said disc including a bore formed therein for engaging with said projection and having a tapered surface formed therein, a cap secured to said disc and including a ring extended away from said disc, a chuck slidably engaged in said ring and including a plurality of blade means extended therefrom for engaging with said tapered surface of said bore, means for biasing said blade means of said chuck to engage with said tapered surface of said bore, and a knob means secured to said chuck for moving said blade means of said chuck away from said bore against said biasing means, said blade means being caused to move radially inward so as to hold said projection in place when said chuck is biased toward said tapered bore, and said blade means being moved radially outward so as to be disengaged from said projection when said chuck is pulled away from said tapered bore by said knob means.

* * * * *